US011769612B2

(12) United States Patent
Moriya

(10) Patent No.: US 11,769,612 B2
(45) Date of Patent: Sep. 26, 2023

(54) CHIP RESISTOR

(71) Applicant: ROHM CO., LTD., Kyoto (JP)

(72) Inventor: Kohsuke Moriya, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 120 days.

(21) Appl. No.: 17/435,258

(22) PCT Filed: Mar. 25, 2020

(86) PCT No.: PCT/JP2020/013184
§ 371 (c)(1),
(2) Date: Aug. 31, 2021

(87) PCT Pub. No.: WO2020/196571
PCT Pub. Date: Oct. 1, 2020

(65) Prior Publication Data

US 2022/0130578 A1 Apr. 28, 2022

(30) Foreign Application Priority Data

Mar. 28, 2019 (JP) ..... 2019-063944

(51) Int. Cl.
*H01C 1/14* (2006.01)
*H01C 1/034* (2006.01)
*H01C 7/00* (2006.01)

(52) U.S. Cl.
CPC ..... *H01C 1/14* (2013.01); *H01C 1/034* (2013.01); *H01C 7/00* (2013.01)

(58) Field of Classification Search
CPC ..... H01C 1/14; H01C 1/034; H01C 7/00
See application file for complete search history.

(56) References Cited

U.S. PATENT DOCUMENTS 6,194,979 B1 * 2/2001 Bloom ..... H01P 1/30 333/172
6,873,244 B2 * 3/2005 Huang ..... H01C 1/1406 338/22 SD (Continued)

FOREIGN PATENT DOCUMENTS

JP 2000156303 6/2000
JP 2004119500 4/2004

(Continued)

OTHER PUBLICATIONS

International Preliminary Report on Patentability issued for International Patent Application No. PCT/JP2020/013184, dated Sep. 28, 2021, 12 pages including English translation.

(Continued)

*Primary Examiner* — Kyung S Lee
(74) *Attorney, Agent, or Firm* — Hamre, Schumann, Mueller & Larson, P.C.

(57) ABSTRACT

A chip resistor includes a resistor body, a first upper surface electrode, a second upper surface electrode, and an upper surface protection film on an upper surface of a substrate. The upper surface protection film covers the entire surface of the resistor body and the entire surface of the first upper surface electrode and the second upper surface electrode. The upper surface protection film includes a peripheral portion that is entirely in contact with the upper surface of the substrate.

19 Claims, 18 Drawing Sheets

(56) References Cited

U.S. PATENT DOCUMENTS

| | | | | |
|---|---|---|---|---|
| 6,882,266 | B2 * | 4/2005 | Christian | H01C 1/144 338/320 |
| 8,085,551 | B2 * | 12/2011 | Karasawa | H01C 17/281 338/205 |
| 8,193,898 | B2 * | 6/2012 | Tonouchi | H01C 7/18 338/254 |
| 2010/0225438 | A1 * | 9/2010 | Wei | H10N 70/066 338/20 |
| 2017/0013718 | A1 | 1/2017 | Hattori et al. | |

FOREIGN PATENT DOCUMENTS

| | | |
|---|---|---|
| JP | 2008117873 | 5/2008 |
| JP | 2017022257 | 1/2017 |

OTHER PUBLICATIONS

International Search Report and Written Opinion issued for International Patent Application No. PCT/JP2020/013184, dated Jul. 7, 2020, 11 pages including English translation of Search Report.

* cited by examiner

CHIP RESISTOR

TECHNICAL FIELD

The present disclosure relates to a chip resistor.

BACKGROUND ART

Patent Document 1 describes a conventional chip resistor as described below. The chip resistor includes a substrate, two upper surface electrodes disposed on the upper surface of the substrate, two lower surface electrodes disposed on the lower surface of the substrate, and side surface electrodes disposed on side surfaces of the substrate to connect the upper surface electrodes and the lower surface electrodes. A resistor body is disposed between the two upper surface electrodes. A protection film is disposed to cover from the register body to the upper surface electrodes. The protection film has an end that is in contact with an end of each side surface electrode. The surface of the side surface electrode is plated. The main component of the upper surface electrodes and the side surface electrodes is, for example, silver.

PRIOR ART DOCUMENT

Patent Document

Patent Document 1: Japanese Laid-Open Patent Publication No. 2000-156303

SUMMARY OF THE INVENTION

Problems that the Invention is to Solve

The usage environment of a chip resistor varies depending on, for example, an electronic device on which the chip resistor is mounted. For example, when the atmosphere contains sulfide such as hydrogen sulfide, a sulfurizing action facilitates deterioration of the upper surface electrodes in which silver is the main component as described above. This may cause the upper surface electrodes to have a faulty conductivity. It may be considered that an anti-sulfurization metal such as palladium is added to the upper surface electrodes. However, such a method increases the resistance value of the upper surface electrodes and fails to obtain a chip resistor having a low resistance.

It is an object of the present disclosure is to provide a chip resistor that has improved anti-sulfurization properties.

Means for Solving the Problems

An aspect of the present disclosure is a chip resistor that includes a substrate including an upper surface and a lower surface that face in opposite directions in a thickness-wise direction and a first through hole and a second through hole that extend through the substrate between the upper surface and the lower surface, a resistor body disposed on the upper surface, an upper surface protection film covering the resistor body and including a peripheral end portion that is entirely in contact with the upper surface, a first lower surface electrode and a second lower surface electrode disposed on the lower surface and separated from each other in a first direction that is orthogonal to the thickness-wise direction, a first inner electrode disposed in the first through hole and connecting the resistor body and the first lower surface electrode, and a second inner electrode disposed in the second through hole and connecting the resistor body and the second lower surface electrode.

In this structure, the peripheral portion of the upper surface protection film, which covers the resistor body, is entirely in contact with the upper surface of the substrate. This limits a faulty conductivity and provides a chip resistor having improved anti-sulfurization properties. In addition, there is no need to add a metal having an anti-sulfurization property. This allows for provision of a chip resistor having a low resistance.

Effects of the Invention

An aspect of the present disclosure provides a chip resistor that has improved anti-sulfurization properties.

MODES FOR CARRYING OUT THE INVENTION

Embodiments of a chip resistor will be described below with reference to the drawings.

The embodiments described below exemplify configurations and methods for embodying a technical concept and are not intended to limit the material, shape, structure, arrangement, dimensions, and the like of each component to the description. The embodiments described below may undergo various modifications.

In this specification, "a state in which member A is connected to member B" includes a case in which member A and member B are directly connected physically and a case in which member A and member B are indirectly connected by another member that does not affect the electric connection state.

In this specification, terms such as "first," "second," and "third" are used as labels and are not intended to sequence objects of the labels.

Figure 1:
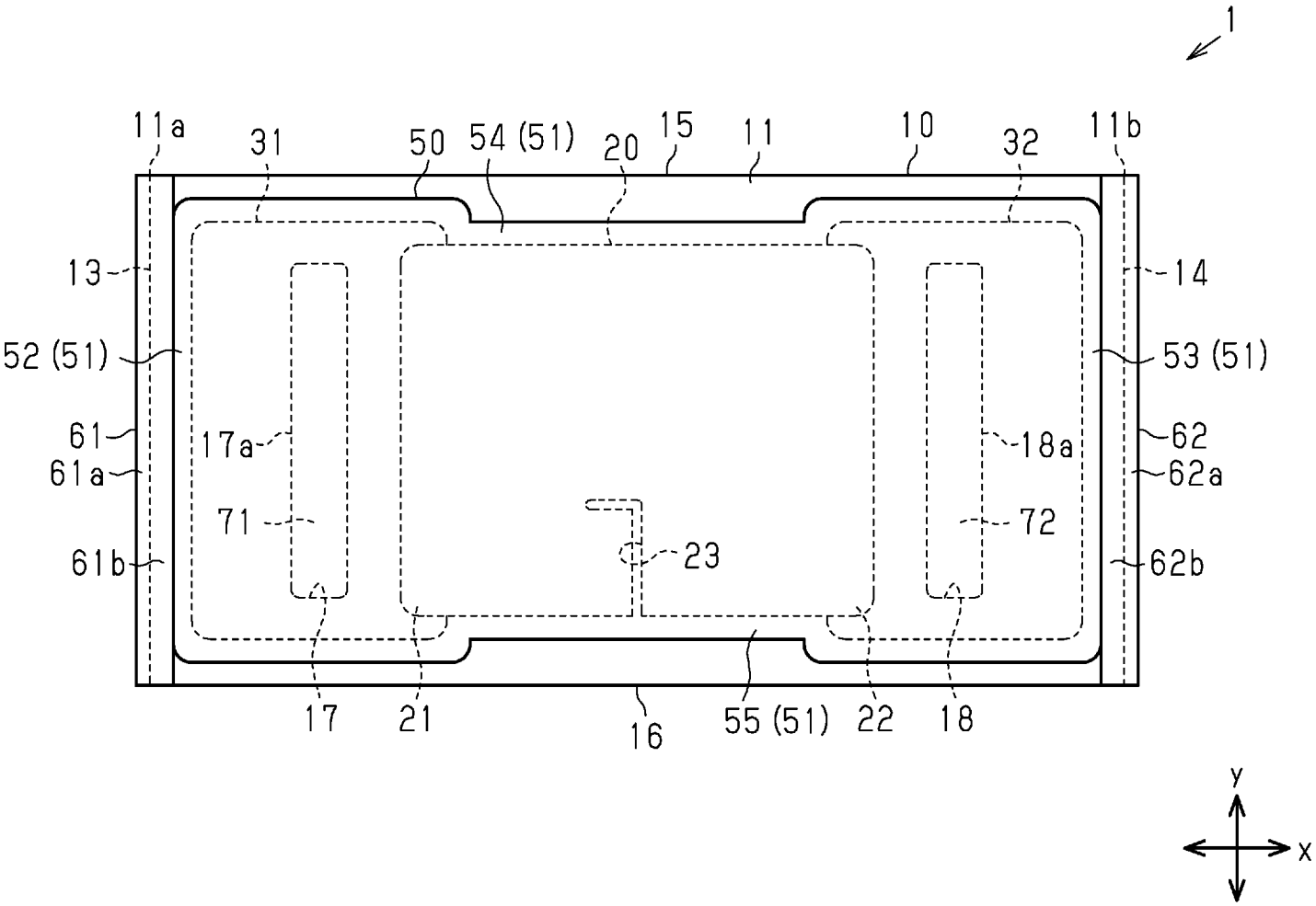
FIG. 1 is a plan view showing a first embodiment of a chip resistor.
Figure 2:
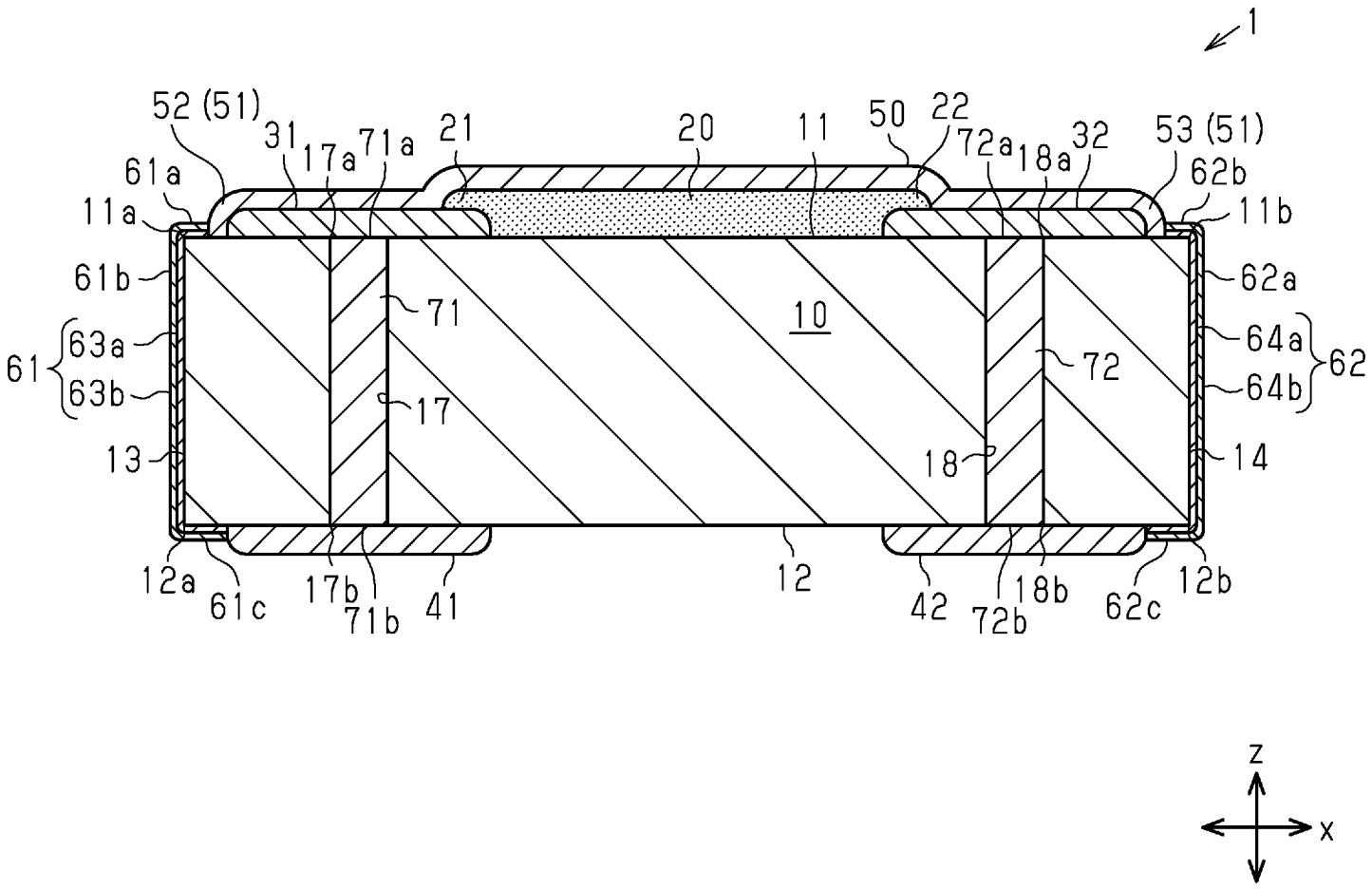
FIG. 2 is a cross-sectional view showing the chip resistor of the first embodiment.
Figure 3:
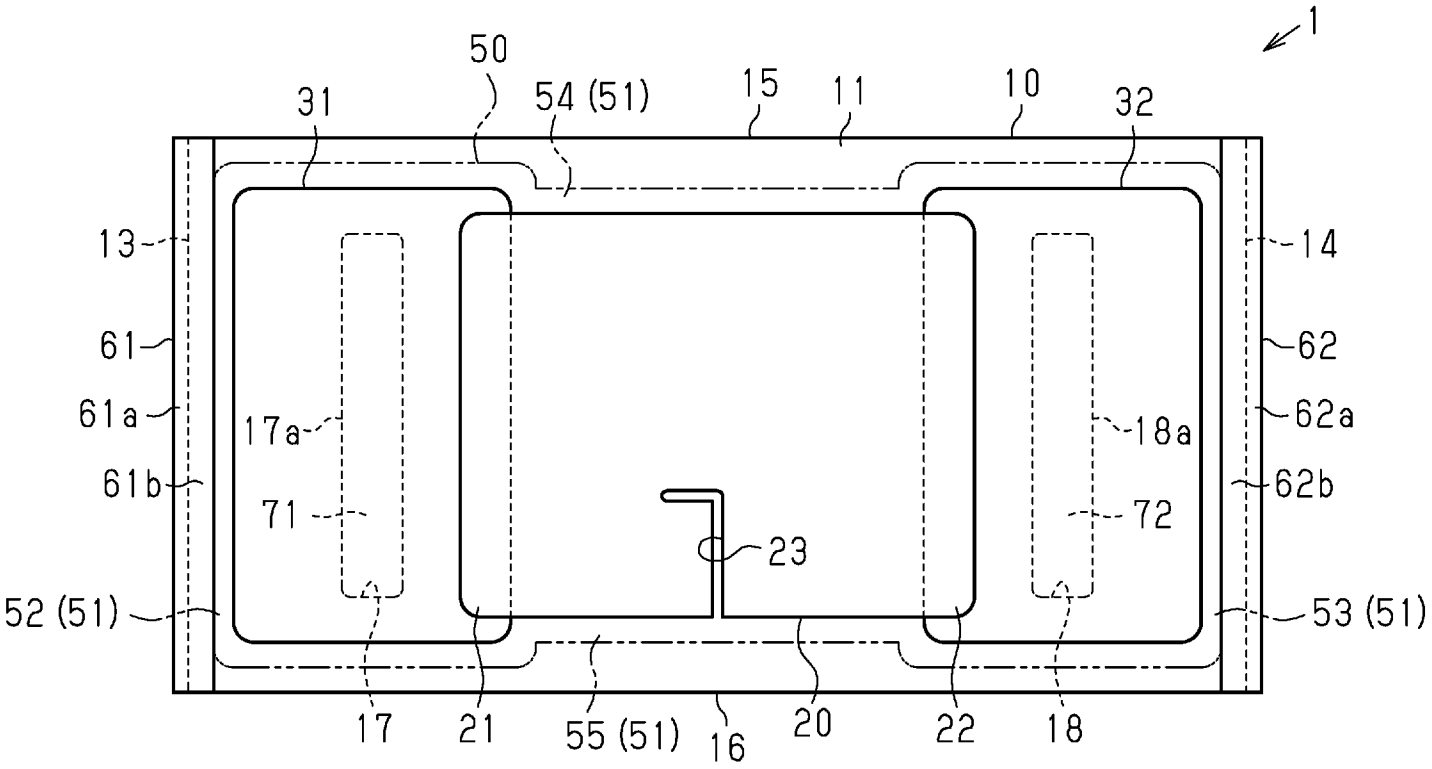
FIG. 3 is a plan view of the chip resistor of the first embodiment showing a protection film by double-dashed lines.

As shown in FIGS. 1, 2, and 3, a chip resistor 1 includes a substrate 10, a resistor body 20, a first upper surface electrode 31, a second upper surface electrode 32, a first lower surface electrode 41, a second lower surface electrode 42, an upper surface protection film 50, a first side surface protection film 61, a second side surface protection film 62, a first inner electrode 71, and a second inner electrode 72.

In this specification, for the sake of convenience, the thickness-wise direction of the substrate 10 is referred to as "the thickness-wise direction z." A direction orthogonal to the thickness-wise direction z is referred to as "the first direction x." A direction orthogonal to the thickness-wise direction z and the first direction x is referred to as "the second direction y."

As viewed in the thickness-wise direction z, the substrate 10 has the shape of a rectangle having long sides defined by two peripheral edges extending in the first direction x. Since the resistor body 20 generates heat when the chip resistor 1 is used, the substrate 10 is formed from an insulation material. The substrate 10 needs to have a superior heat dissipation property. Hence, it is desirable that the material forming the substrate 10 has a relatively high thermal conductivity. In the chip resistor 1, the material forming the substrate 10 is alumina ($Al_2O_3$).

The substrate 10 includes an upper surface 11, a lower surface 12, and side surfaces 13, 14, 15, and 16. As shown in FIG. 2, the upper surface and the lower surface 12 face in opposite directions in the thickness-wise direction z. As shown in FIG. 1, the side surfaces 13 and 14 face in opposite directions in the first direction x, and the side surfaces 15 and 16 face in opposite directions in the second direction y. The upper surface 11 faces upward in FIG. 2. The lower surface 12 faces downward in FIG. 2. When the chip resistor 1 is mounted on a circuit board, the lower surface 12 faces the circuit substrate. Each of the upper surface 11 and the lower surface 12 is flat.

The substrate 10 includes a first through hole 17 and a second through hole 18 extending through the substrate 10 in the thickness-wise direction z. The first through hole 17 and the second through hole 18 are separated from each other in the first direction x. The first through hole 17 has quadrangular openings in the upper surface 11 and the lower surface 12 of the substrate 10. In this specification, a quadrangular shape includes a quadrangle having a rounded corner. The second through hole 18 has quadrangular openings in the upper surface 11 and the lower surface 12 of the substrate 10.

The first inner electrode 71 is disposed in the first through hole 17. The first inner electrode 71 includes an upper surface 71*a* that is substantially flush with the upper surface 11 of the substrate 10. The first inner electrode 71 includes a lower surface 71*b* that is substantially flush with the lower surface 12 of the substrate 10. At least one of the upper surface 71*a* or the lower surface 71*b* of the first inner electrode 71 may be recessed toward the inside of the first inner electrode 71.

The second inner electrode 72 is disposed in the second through hole 18. The second inner electrode 72 includes an upper surface 72*a* that is substantially flush with the upper surface 11 of the substrate 10. The second inner electrode 72 includes a lower surface 72*b* that is substantially flush with the lower surface 12 of the substrate 10. At least one of the upper surface 72*a* or the lower surface 72*b* of the second inner electrode 72 may be recessed toward the inside of the second inner electrode 72. The material forming the first inner electrode 71 and the second inner electrode 72 includes silver and glass.

The first upper surface electrode 31, the second upper surface electrode 32, and the resistor body 20 are disposed on the upper surface 11 of the substrate 10.

As viewed in the thickness-wise direction z, the resistor body 20 is belt-shaped and extends in the first direction x. In the chip resistor 1 of the present embodiment, the resistor body 20 is disposed between the first through hole 17 and the second through hole 18 of the substrate 10. The material forming the resistor body 20 includes metal particles and glass. The metal particles are, for example, ruthenium dioxide ($RuO_2$) or a silver (Ag)-palladium (Pd) alloy.

As shown in FIGS. 1 and 3, the resistor body 20 includes a trimming groove 23. The trimming groove 23 extends through the resistor body 20 in the thickness-wise direction z. The trimming groove 23 is L-shaped as viewed in the thickness-wise direction z. The trimming groove 23 opens part of an end of the resistor body 20 in the second direction y.

The first upper surface electrode 31 and the second upper surface electrode 32 are separated from each other in the first direction x and in contact with the upper surface 11 of the substrate 10. The first upper surface electrode 31 and the second upper surface electrode 32 are band-shaped and extend in the second direction y. The material forming the first upper surface electrode 31 and the second upper surface electrode 32 includes silver and glass.

The resistor body 20 is in contact with the upper surface 11 at a central portion of the substrate 10 in the first direction x. In addition, opposite ends of the resistor body 20 in the first direction x overlap and contact the first upper surface electrode 31 and the second upper surface electrode 32. The resistor body 20 includes a first covering portion 21 that covers part of the first upper surface electrode 31 and a second covering portion 22 that covers part of the second upper surface electrode 32. Thus, the first upper surface electrode 31 and the second upper surface electrode 32 are electrically connected to the resistor body 20.

The first upper surface electrode 31 covers an opening 17*a* of the first through hole 17 in the upper surface 11 of the substrate 10 and is electrically connected to the first inner electrode 71 disposed in the first through hole 17. The second upper surface electrode 32 covers an opening 18*a* of the second through hole 18 in the upper surface 11 of the substrate 10 and is electrically connected to the second inner electrode 72 disposed in the second through hole 18.

The upper surface protection film 50 covers the entire surface of the resistor body 20 and the entire surface of the first upper surface electrode 31 and the second upper surface electrode 32. The upper surface protection film 50 includes a peripheral portion 51 in contact with the upper surface 11 of the substrate 10. The peripheral portion 51 includes edges 52 and 53 in the first direction x and edges 54 and 55 in the second direction y. The edges 52, 53, 54, and 55 are in contact with the upper surface 11 of the substrate 10. The material forming the upper surface protection film 50 has a satisfactory adhesion to the substrate 10. The material forming the upper surface protection film 50 is resin, for example, a colored epoxy resin. The material forming the upper surface protection film 50 may be a resin containing glass and carbon particles (carbon black).

The first lower surface electrode 41 and the second lower surface electrode 42 are disposed on the lower surface 12 of the substrate 10.

The first lower surface electrode 41 and the second lower surface electrode 42 are separated from each other in the first direction x and in contact with the lower surface 12 of the substrate 10. The first lower surface electrode 41 and the second lower surface electrode 42 are band-shaped and extend in the second direction y. The material forming the first lower surface electrode 41 and the second lower surface electrode 42 includes silver and glass.

As shown in FIG. 2, the first lower surface electrode 41 covers an opening 17*b* of the first through hole 17 in the lower surface 12 of the substrate 10 and is electrically connected to the first inner electrode 71 disposed in the first through hole 17. The second lower surface electrode 42 covers an opening 18*b* of the second through hole 18 in the lower surface 12 of the substrate 10 and is electrically connected to the second inner electrode 72 disposed in the second through hole 18.

The first side surface protection film 61 includes a side surface portion 61*a*, an upper surface portion 61*b*, and a lower surface portion 61*c*. The side surface portion 61*a* covers the entire side surface 13 of the substrate 10. The upper surface portion 61*b* covers the upper surface 11 of the substrate 10 between an end 11*a* of the upper surface 11 of the substrate 10 and the upper surface protection film 50 and is in contact with the edge 52 of the upper surface protection film 50. The lower surface portion 61*c* covers the lower surface 12 of the substrate 10 between an end 12*a* of the lower surface 12 of the substrate 10 and the first lower surface electrode 41 and is in contact with the first lower surface electrode 41.

The second side surface protection film 62 includes a side surface portion 62*a*, an upper surface portion 62*b*, and a lower surface portion 62*c*. The side surface portion 62*a* covers the entire side surface 13 of the substrate 10. The upper surface portion 62*b* covers the upper surface 11 of the substrate 10 between an end 11*b* of the upper surface 11 of the substrate 10 and the upper surface protection film 50 and is in contact with the edge 53 of the upper surface protection film 50. The lower surface portion 62*c* covers the lower surface 12 of the substrate 10 between an end 12*b* of the lower surface 12 of the substrate 10 and the first lower surface electrode 41 and is in contact with the second lower surface electrode 42.

In the chip resistor 1 of the present embodiment, the first side surface protection film 61 and the second side surface protection film 62 are metal films.

The first side surface protection film 61 includes a first metal film 63*a* and a second metal film 63*b*. The material forming the first metal film 63*a* includes nickel (Ni). The material forming the second metal film 63*b* includes tin (Sn). In the present embodiment, the first side surface protection film 61 is electrically connected to the first lower surface electrode 41 and is electrically disconnected from the first upper surface electrode 31.

The second side surface protection film 62 includes a first metal film 64*a* and a second metal film 64*b*. The material forming the first metal film 64*a* includes nickel. The material forming the second metal film 64*b* includes tin. In the present embodiment, the second side surface protection film 62 is electrically connected to the second lower surface electrode 42 and is electrically disconnected from the second upper surface electrode 32.

Operation

The operation of the chip resistor 1 will now be described.

In the chip resistor 1 of the present embodiment, the resistor body 20, the first upper surface electrode 31, the second upper surface electrode 32, and the upper surface protection film 50 are disposed on the upper surface 11 of the substrate 10. The upper surface protection film 50 covers the entire surface of the resistor body 20 and the entire surface of the first upper surface electrode 31 and the second upper surface electrode 32. The peripheral portion 51 of the upper surface protection film 50 is in contact with the upper surface 11 of the substrate 10. The peripheral portion 51 of the upper surface protection film 50, which is formed from resin, is in tight contact with the upper surface 11 of the substrate 10 to hinder entrance of the atmosphere in the space where the chip resistor 1 is used between the upper surface protection film 50 and the substrate 10. Thus, even when the atmosphere contains a relatively high amount of sulfide such as hydrogen sulfide, deterioration of the first upper surface electrode 31 and the second upper surface electrode 32 caused by a sulfurizing action is limited. That is, the anti-sulfurization properties are improved.

Figure 4:
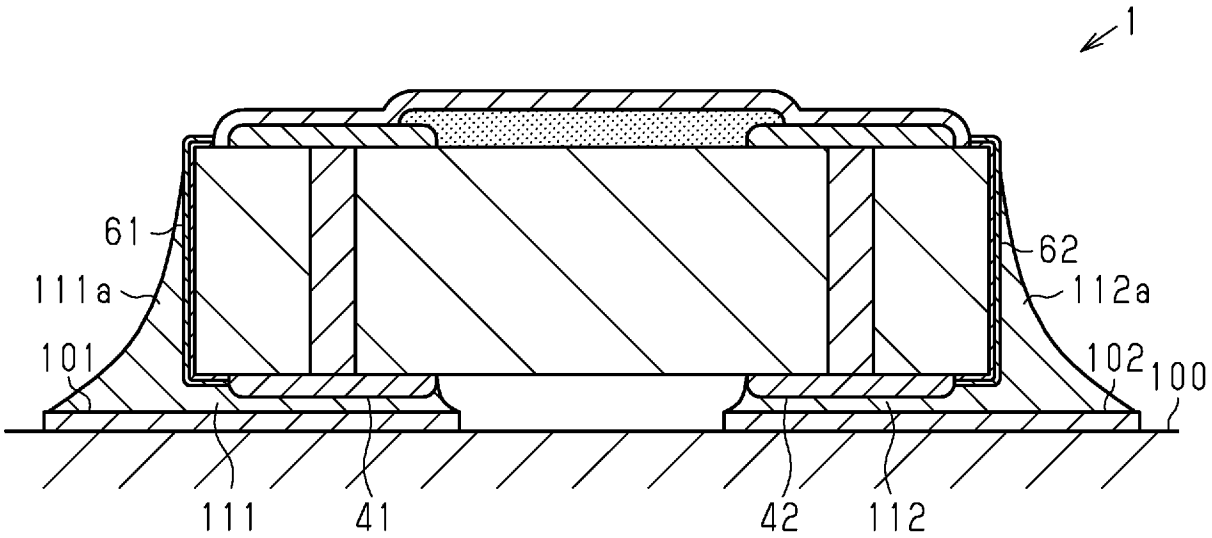
FIG. 4 is a cross-sectional view showing a mount state of the chip resistor of the first embodiment.

As shown in FIG. 4, the chip resistor 1 is mounted on a circuit board 100.

The first lower surface electrode 41 and the second lower surface electrode 42 are disposed to face pads 101 and 102 and bonded by solder portions 111 and 112. The solder portions 111 and 112 form solder fillets 111*a* and 112*a* by the first side surface protection film 61 and the second side surface protection film 62. The solder fillets 111*a* and 112*a* allow the mount state of the chip resistor 1 to be checked. In addition, while the first lower surface electrode 41 and the second lower surface electrode 42 provide a sufficient bonding strength, and the solder fillets 111*a* and 112*a* further improve the mounting strength of the chip resistor 1.

As described above, the present embodiment has the advantages described below.

(1) In the chip resistor 1, the resistor body 20, the first upper surface electrode 31, the second upper surface electrode 32, and the upper surface protection film 50 are disposed on the upper surface 11 of the substrate 10. The upper surface protection film 50 covers the entire surface of the resistor body 20 and the entire surface of the first upper surface electrode 31 and the second upper surface electrode 32. The peripheral portion 51 of the upper surface protection film 50 is in contact with the upper surface 11 of the substrate 10. Thus, the anti-sulfurization properties are improved.

(2) In the chip resistor 1, the first lower surface electrode 41 is electrically connected to the resistor body 20 by the first inner electrode 71 and the first upper electrode, and the second lower surface electrode 42 is electrically connected to the resistor body 20 by the second inner electrode 72 and the second upper surface electrode 32. Thus, the entire surface of the first upper surface electrode 31 and the second upper surface electrode 32 is covered by the upper surface protection film 50, so that sulfurization of the first upper surface electrode 31 and the second upper surface electrode 32 is limited.

(3) The first lower surface electrode 41 and the second lower surface electrode 42 are disposed to face the pads 101 and 102 and bonded by the solder portions 111 and 112. The solder fillets 111*a* and 112*a* formed of the solder portions 111 and 112 allow the mount state of the chip resistor 1 to be checked. In addition, the mounting strength of the chip resistor 1 is improved.

Modified Examples

FIGS. 5 to 18 show modified examples of the present disclosure.

In the drawings, the same reference characters are given to those elements that are the same as or similar to the corresponding elements of the embodiment.

Figure 5:
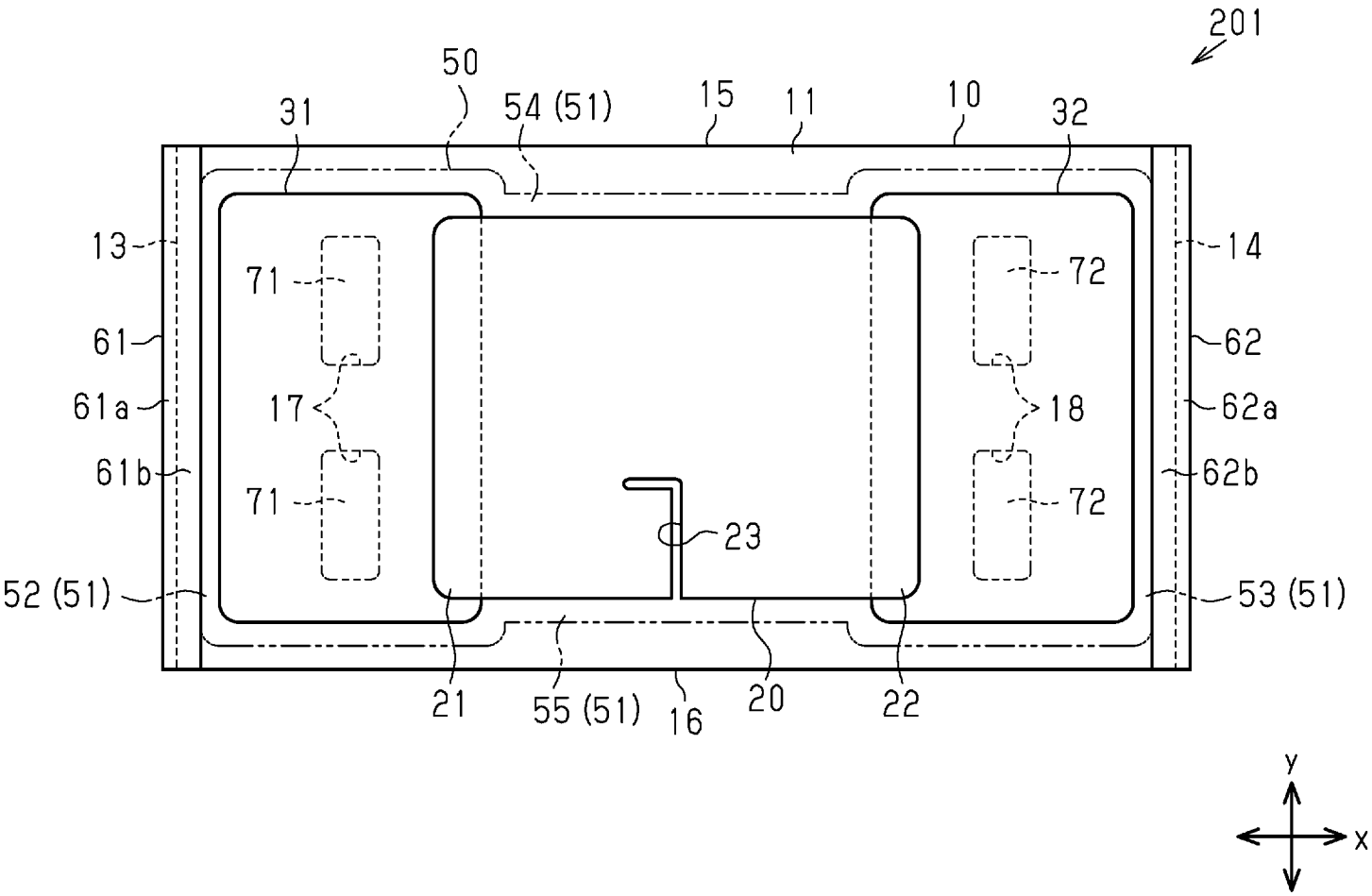
FIG. 5 is a plan view of a modified example of a chip resistor showing an upper surface protection film by double-dashed lines.

FIG. 5 shows a chip resistor 201 in which the substrate 10 includes two first through holes 17 and two second through holes 18. Each of the first through holes 17 and the second through holes 18 has a quadrangular opening in the upper surface 11 of the substrate 10. The two first through holes 17 are arranged in the second direction y, and the two second through holes 18 arranged in the second direction y. The chip resistor 201 obtains the same advantages as the embodiment.

Three or more first through holes 17 and three or more second through holes 18 may be arranged. The number of first through holes 17 may differ from the number of second through holes 18. For example, one first through hole 17 and two second through holes 18 may be formed in a substrate. The first through holes 17 may be arranged at different positions as viewed in the second direction y. The second through holes 18 may be arranged at different positions as viewed in the second direction y.

Figure 6:
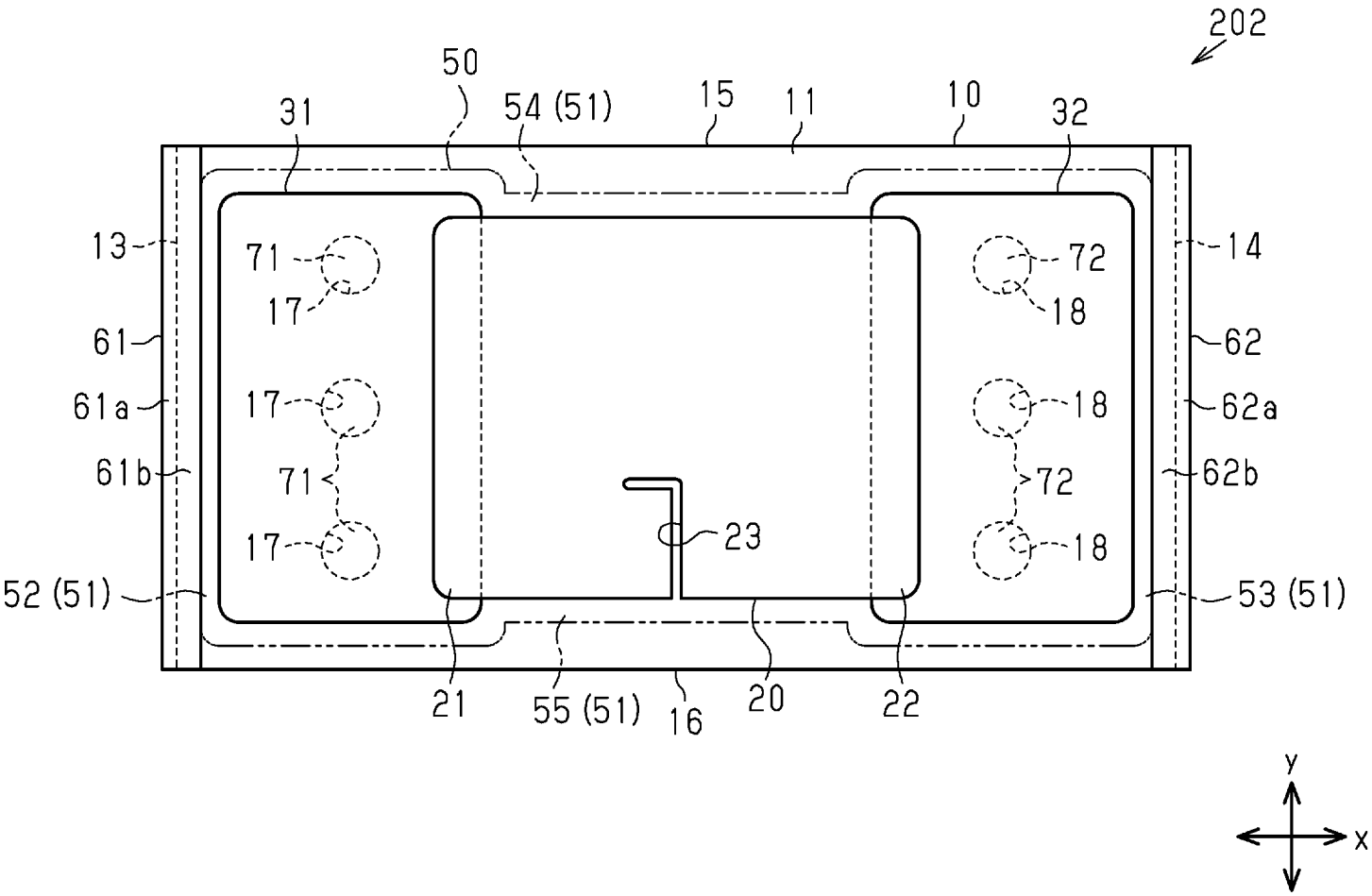
FIG. 6 is a plan view of a modified example of a chip resistor showing an upper surface protection film by double-dashed lines.

FIG. 6 shows a chip resistor 202 in which the substrate 10 includes three first through holes 17 and three second through holes 18. Each of the first through holes 17 and the second through holes 18 has a circular opening in the upper surface 11 of the substrate 10. The three first through holes 17 are arranged in the second direction y, and the three second through holes 18 are arranged in the second direction y. The chip resistor 202 obtains the same advantages as the embodiment. As described in the chip resistor 201 shown in FIG. 5, in the chip resistor 202, the number and the arrangement positions of first through holes 17 and second through holes 18 may be changed.

Figure 7:
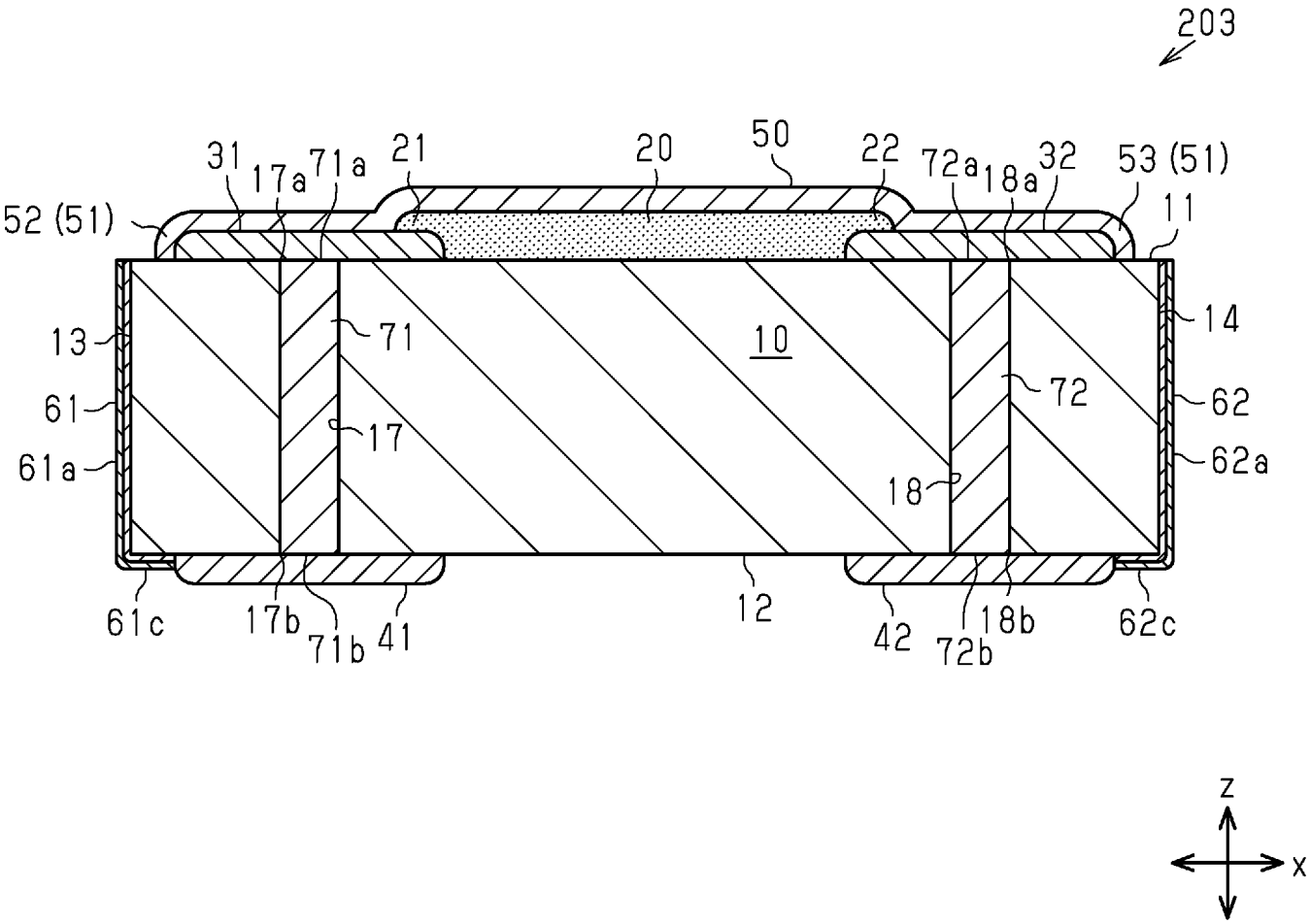
FIG. 7 is a cross-sectional view showing a modified example of a chip resistor.

FIG. 7 shows a chip resistor 203 in which the first side surface protection film 61 and the second side surface protection film 62 include the side surface portion 61*a*, the side surface portion 62*a*, the lower surface portion 61*c*, and the lower surface portion 62*c* in the same manner as the embodiment but do not include an upper surface portion that is in contact with the upper surface 11 of the substrate 10. The chip resistor 203 obtains the same advantages as the embodiment.

Figure 8:
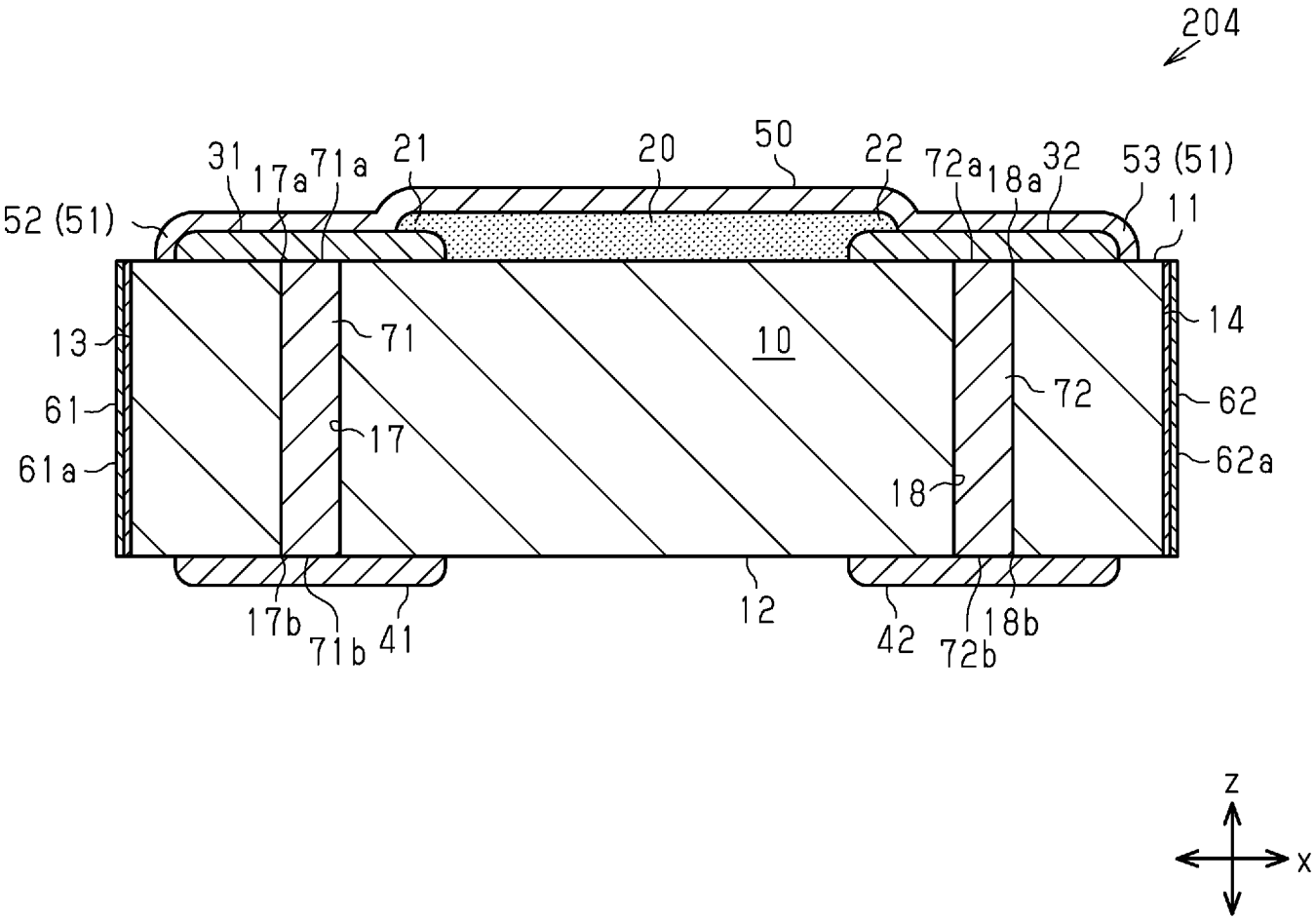
FIG. 8 is a cross-sectional view showing a modified example of a chip resistor.

FIG. 8 shows a chip resistor 204 in which the first side surface protection film 61 and the second side surface protection film 62 include the side surface portion 61*a* and the side surface portion 62*a* in the same manner as the embodiment but do not include an upper surface portion that is in contact with the upper surface 11 of the substrate 10 and a lower surface portion that is in contact with the lower surface 12. The chip resistor 204 obtains the same advantages as the embodiment.

Figure 9:
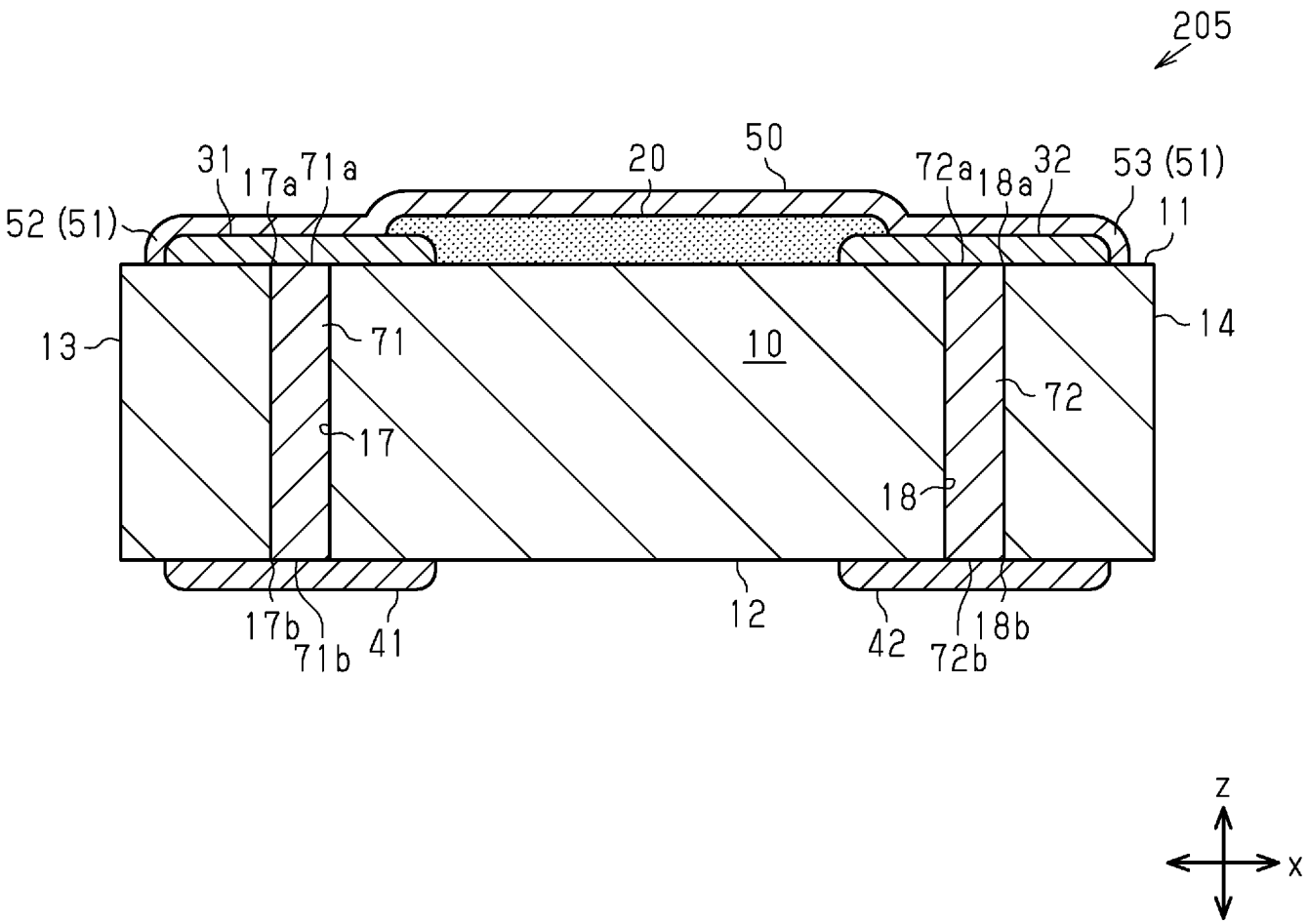
FIG. 9 is a cross-sectional view showing a modified example of a chip resistor.

FIG. 9 shows a chip resistor 205 that does not include the first side surface protection film 61 and the second side surface protection film 62 of the embodiment. While the first lower surface electrode 41 and the second lower surface electrode 42 provide a sufficient mounting strength, the cost of the chip resistor 205 is reduced.

Figure 10:
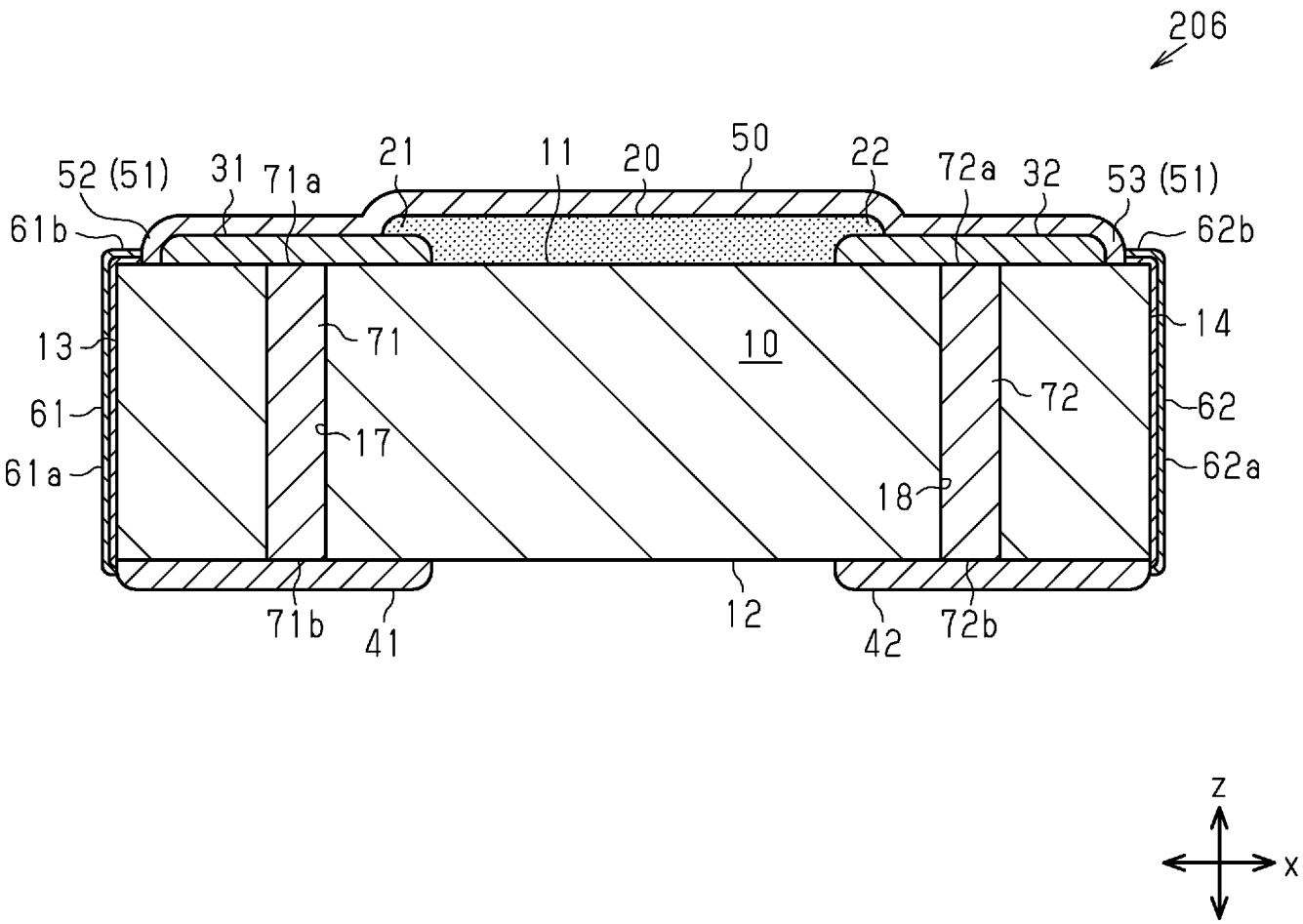
FIG. 10 is a cross-sectional view showing a modified example of a chip resistor.

FIG. 10 shows a chip resistor 206 in which the first lower surface electrode 41 and the second lower surface electrode 42 differ in size from the first upper surface electrode 31 and the second upper surface electrode 32. In FIG. 10, the first lower surface electrode 41 and the second lower surface electrode 42 extend to the respective ends of the substrate 10 in the first direction x. This improves the mounting and bonding of the first lower surface electrode 41 and the second lower surface electrode 42 to a circuit board or the like.

Figure 11:
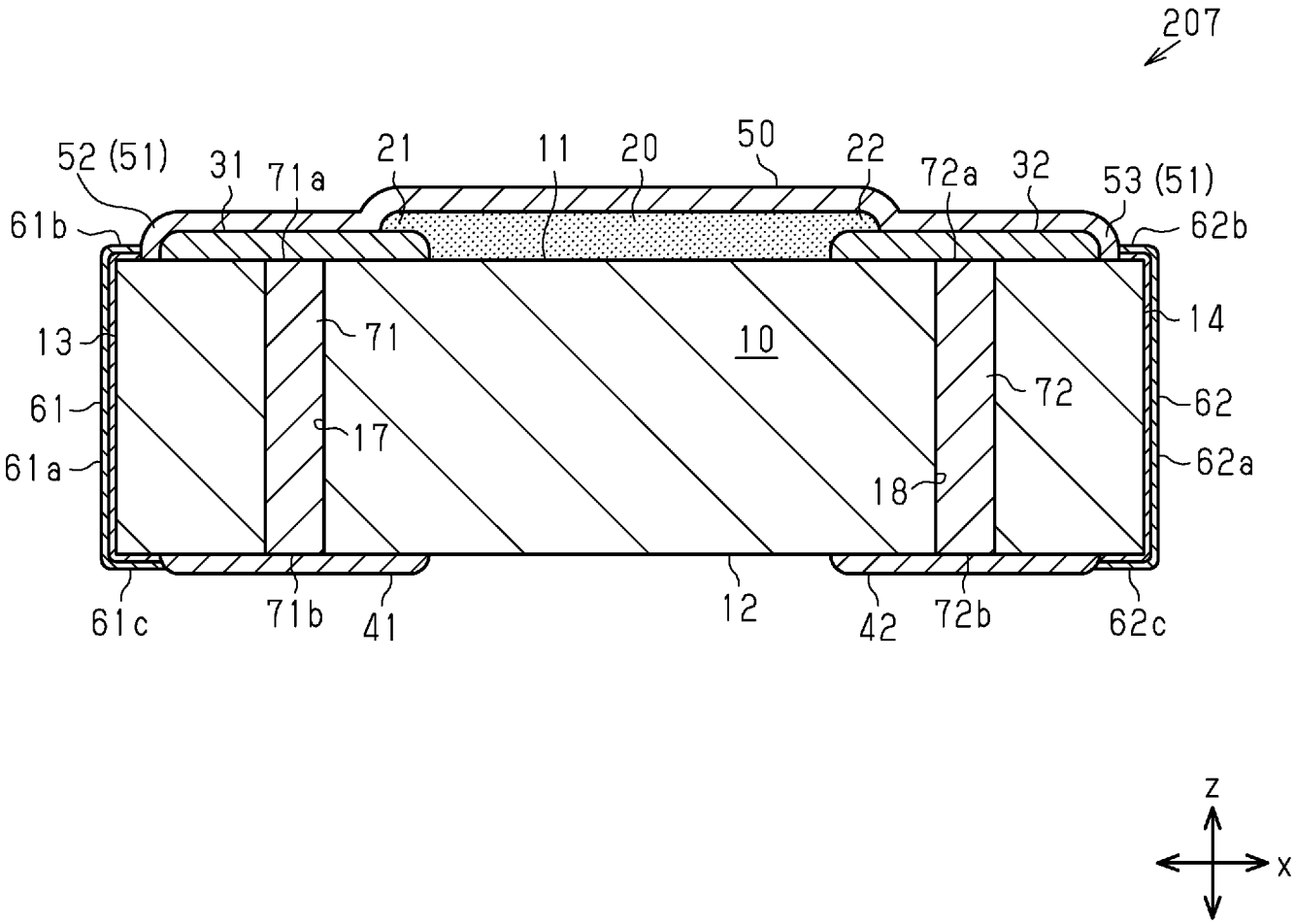
FIG. 11 is a cross-sectional view showing a modified example of a chip resistor.

FIG. 11 shows a chip resistor 207 in which the first lower surface electrode 41 and the second lower surface electrode 42 differ in thickness from the first upper surface electrode 31 and the second upper surface electrode 32. In FIG. 11, the first lower surface electrode 41 and the second lower surface electrode 42 are smaller in thickness than the first upper surface electrode 31 and the second upper surface electrode 32. The chip resistor 207 obtains the same advantages as the embodiment.

Figure 12:
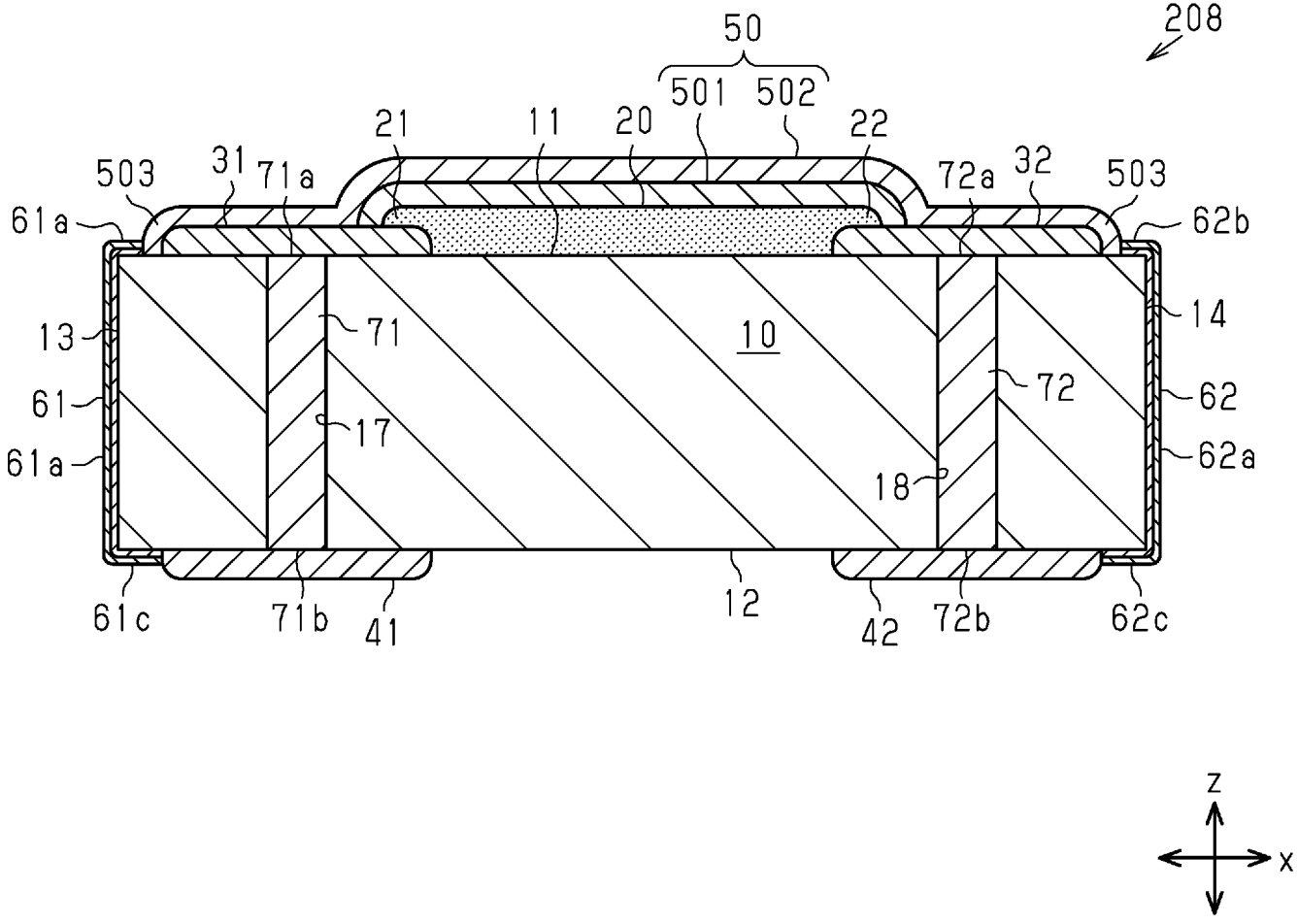
FIG. 12 is a cross-sectional view showing a modified example of a chip resistor.

FIG. 12 shows a chip resistor 208 in which the upper surface protection film 50 includes a first protection film 501 and a second protection film 502. The first protection film 501 covers the entire surface of the resistor body 20 and part of the first upper surface electrode 31 and the second upper surface electrode 32. The second protection film 502 covers the first protection film 501 and the surface of the first upper surface electrode 31 and the second upper surface electrode 32. The second protection film 502 includes a peripheral portion 503 that is entirely in contact with the upper surface 11 of the substrate 10. Preferably, the material forming the first protection film 501 has a high adhesion to the upper surface 11 of the substrate 10. In the chip resistor 208, the thickness of the portion of the film covering the resistor body 20 is adjustable. The material forming the first protection film 501 may be the same or differ from the material forming the second protection film 502.

Figure 13:
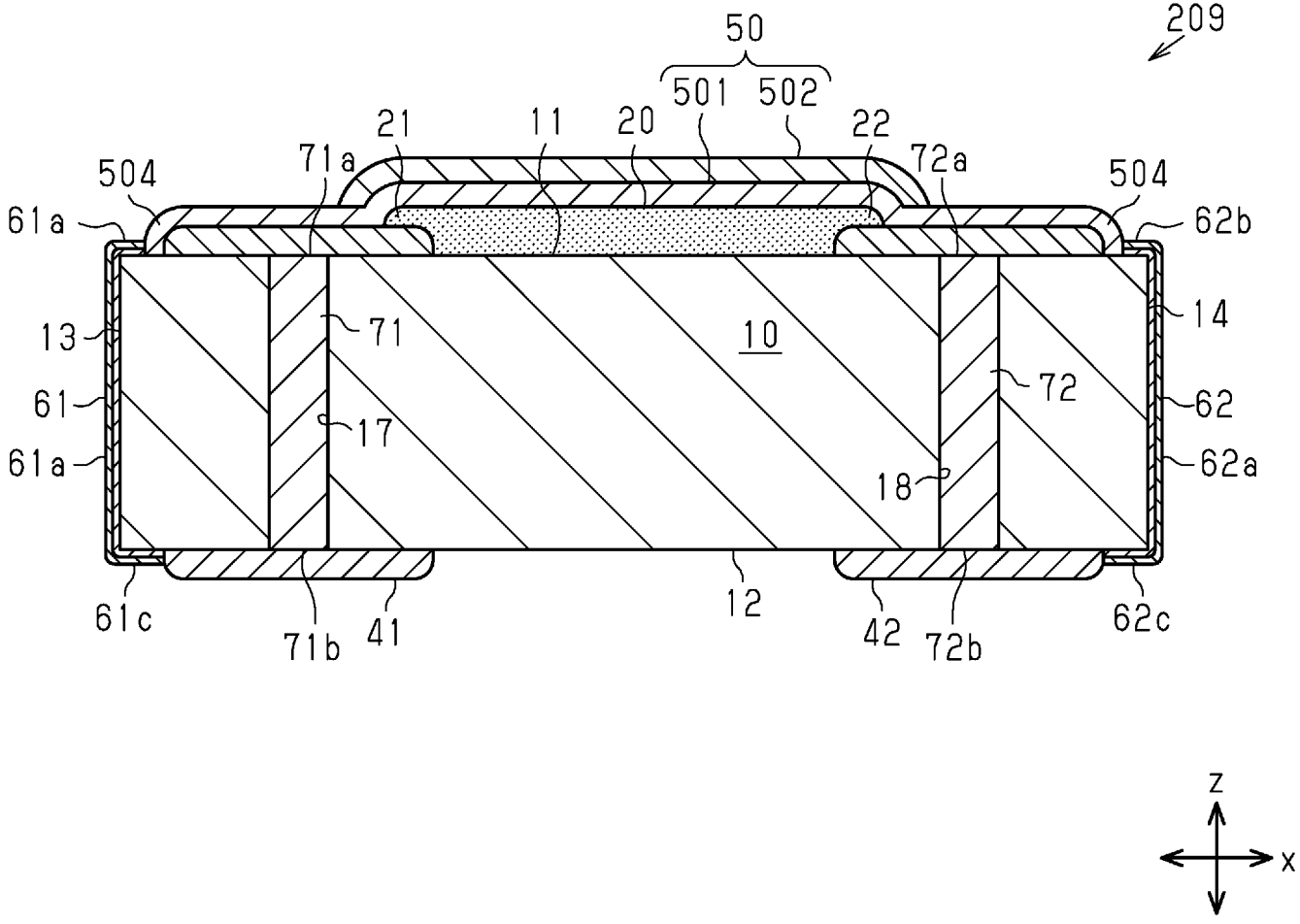
FIG. 13 is a cross-sectional view showing a modified example of a chip resistor.

FIG. 13 shows a chip resistor 209 in which the upper surface protection film 50 includes a first protection film 501 and a second protection film 502. The first protection film 501 covers the resistor body 20 and the surface of the first upper surface electrode 31 and the second upper surface electrode 32. The first protection film 501 includes a peripheral portion 504 that is entirely in contact with the upper surface 11 of the substrate 10. The second protection film 502 covers the surface of the first protection film 501 above the resistor body 20. In the chip resistor 209, the thickness of the portion of the film covering the resistor body 20 is adjustable. The material forming the first protection film 501 may be the same or differ from the material forming the second protection film 502.

Figure 14:
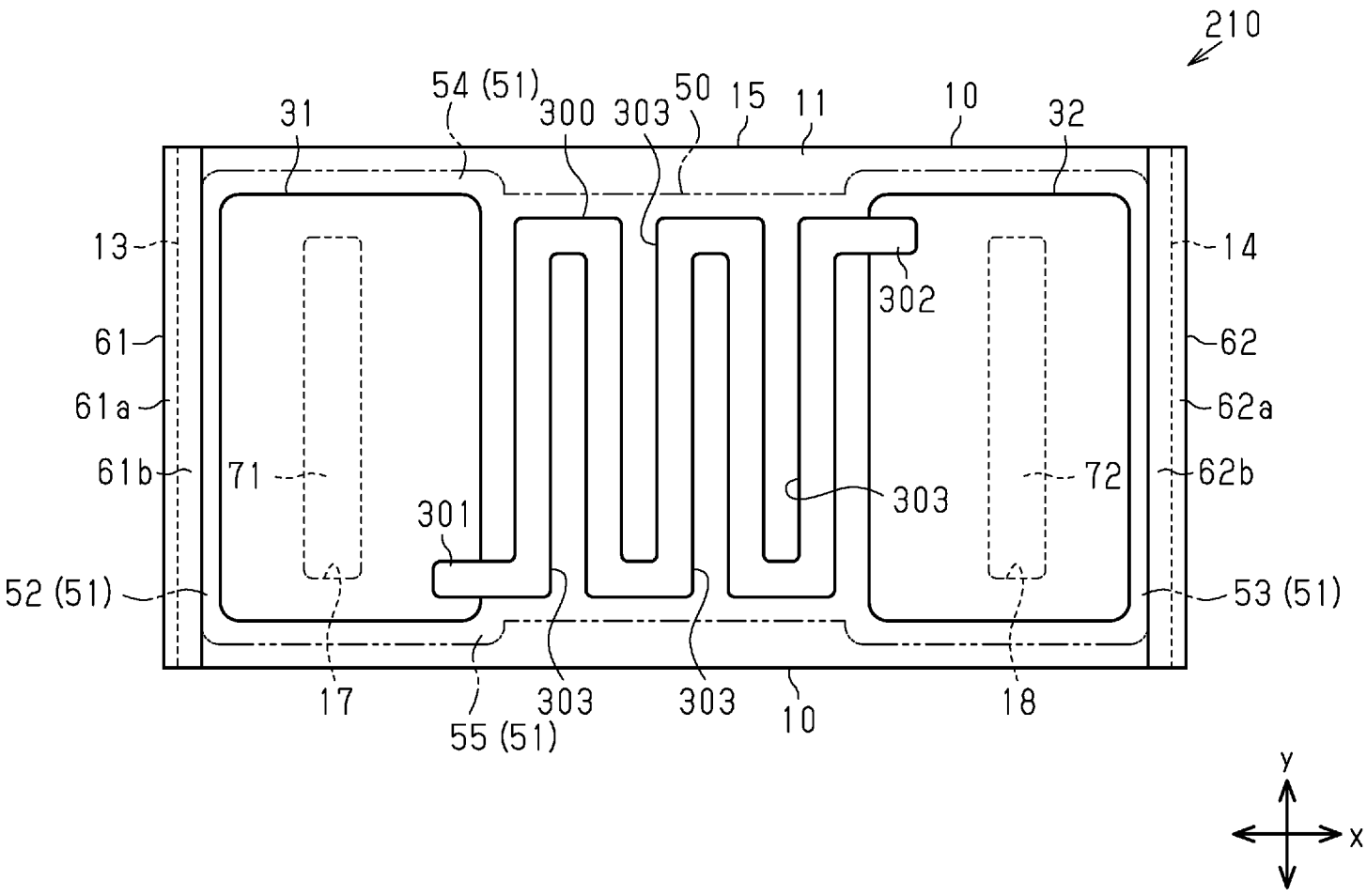
FIG. 14 is a plan view of a modified example of a chip resistor showing an upper surface protection film by double-dashed lines.

FIG. 14 shows a chip resistor 210 including a resistor body 300 that differs in shape from that of the embodiment. In the chip resistor 210, a conductive path of the resistor body 300 is elongated so that damage is reduced when a surge current flows.

The resistor body 300 includes extensions 301 and 302 extending in the first direction x. Part of the extension 301 overlaps the first upper surface electrode 31. Part of the extension 302 overlaps the second upper surface electrode 32.

The resistor body 300 include grooves 303. The grooves 303 are slits extending toward the inside of the resistor body 20. The grooves 303 are arranged in the first direction x so that grooves that open upward in the drawing and extend in the second direction y alternate with grooves that open downward in the drawing and extend in the second direction y. When the grooves 303 are arranged in such a manner, the resistor body 300 is serpentine-shaped. The grooves 303 may extend in the first direction x.

Figure 15:
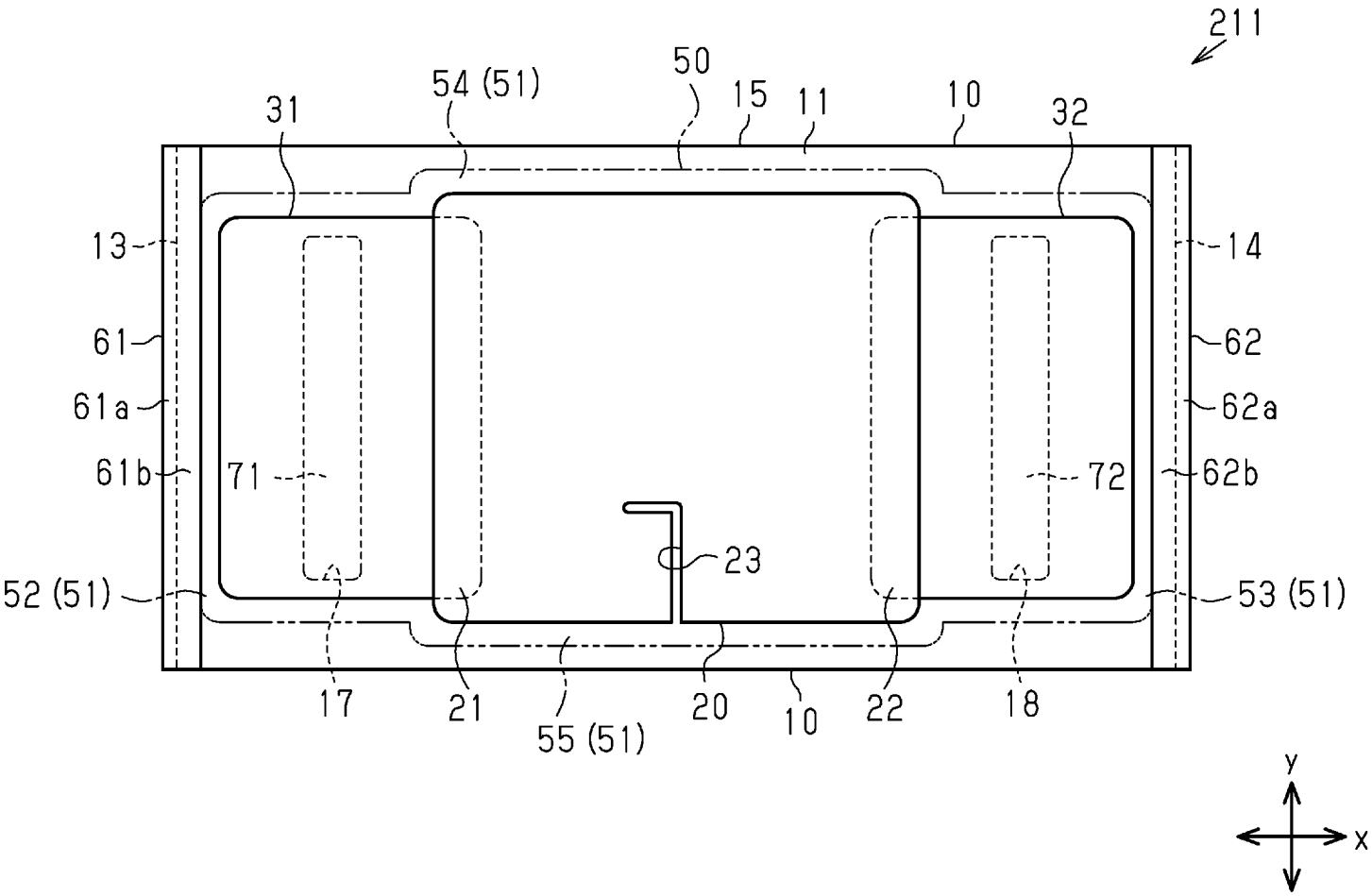
FIG. 15 is a plan view of a modified example of a chip resistor showing an upper surface protection film by double-dashed lines.

FIG. 15 shows a chip resistor 211 in which the width of the resistor body 20 in the second direction y is greater than the width of the first upper surface electrode 31 and the width of the first upper surface electrode 31 in the second direction y. The chip resistor 211 obtains the same advantages as the embodiment.

Figure 16:
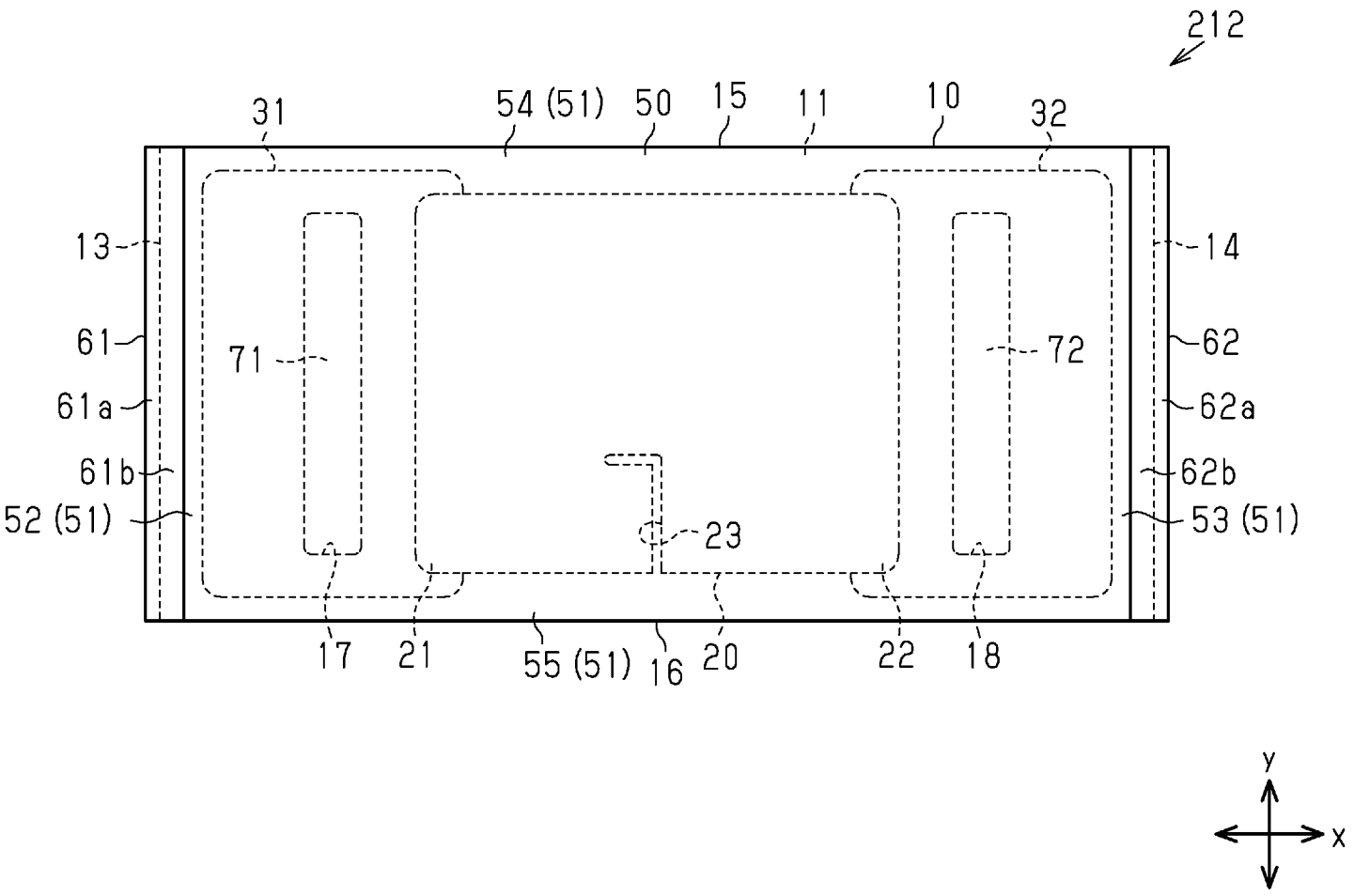
FIG. 16 is a plan view showing a modified example of a chip resistor.

FIG. 16 shows a chip resistor 212 in which the upper surface protection film 50 covers the upper surface 11 of the substrate 10 to the side surfaces 15 and 16, which face opposite sides of the substrate 10 in the second direction y. The chip resistor 212 obtains the same advantages as the embodiment.

Figure 17:
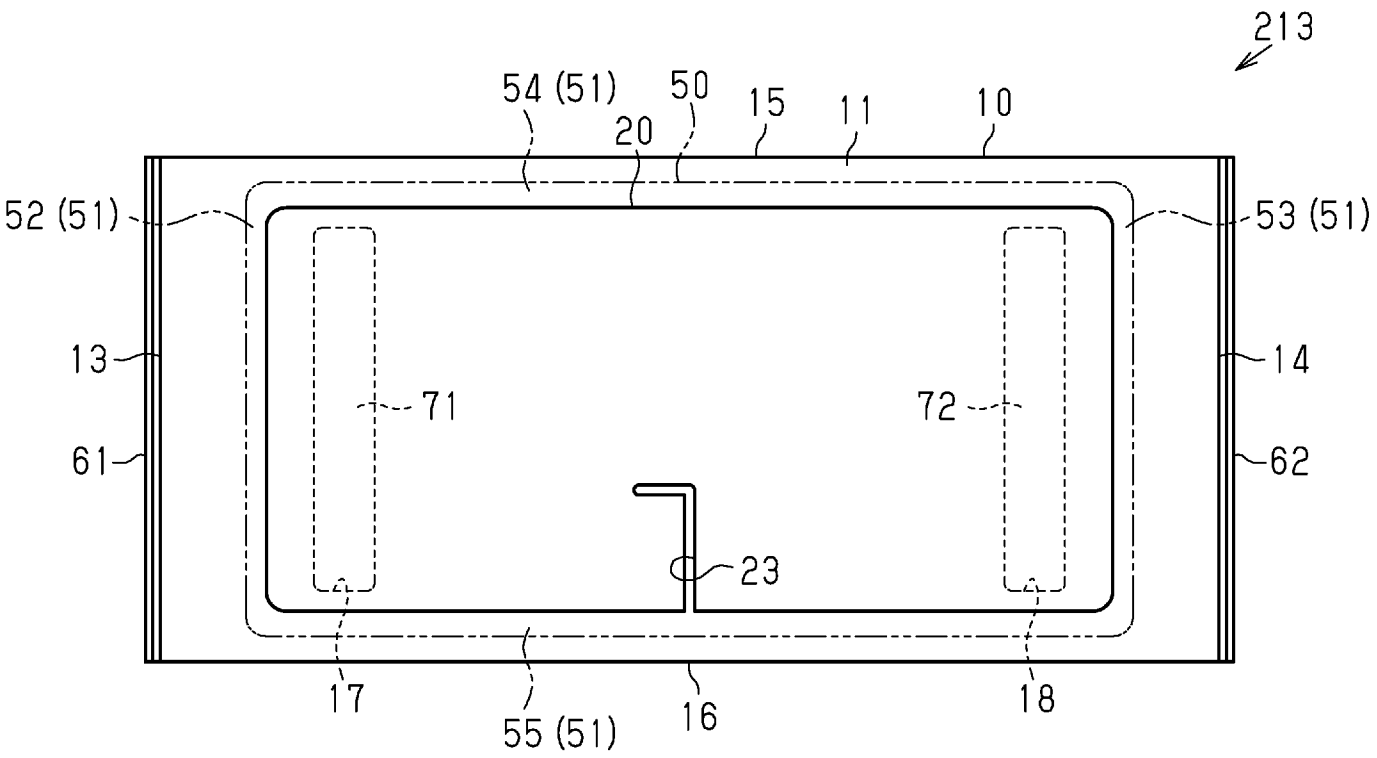
FIG. 17 is a plan view of a modified example of a chip resistor showing an upper surface protection film by double-dashed lines.
Figure 18:
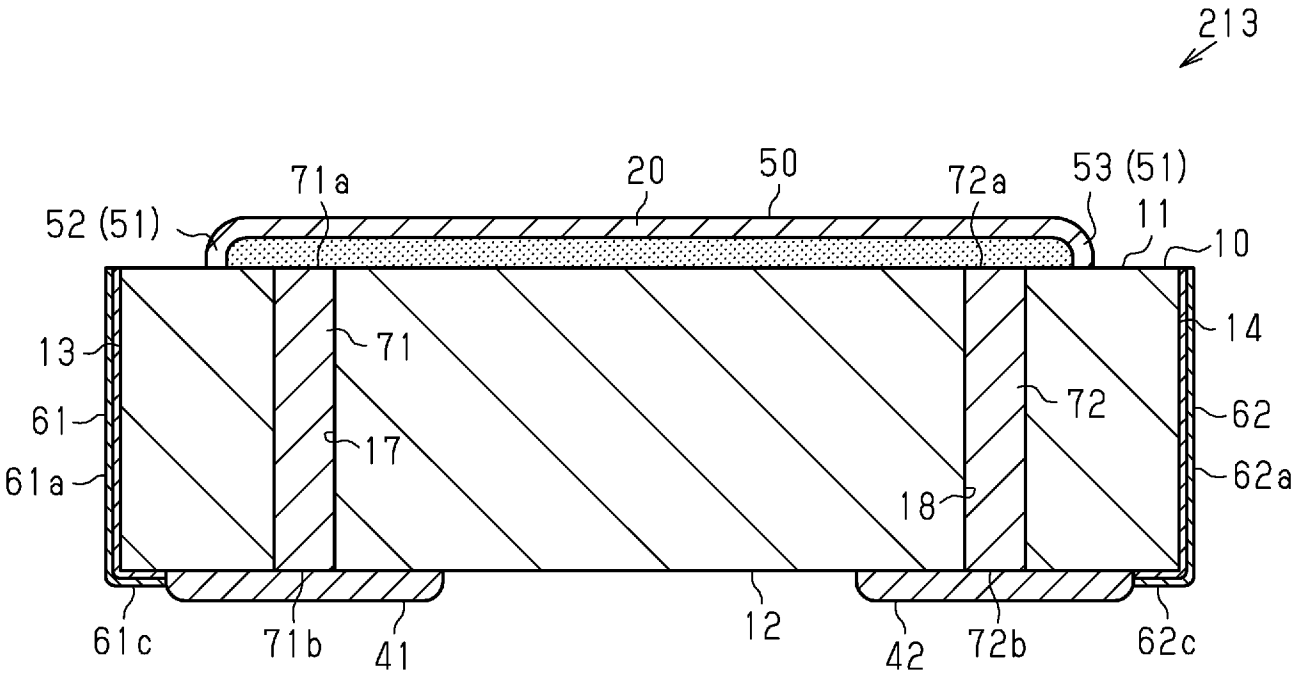
FIG. 18 is a cross-sectional view showing the chip resistor of the modified example.

FIGS. 17 and 18 show a chip resistor 213 in which the resistor body 20 covers the first through hole 17 and the second through hole 18 of the substrate 10. Thus, the first inner electrode 71 and the second inner electrode 72 are in direct contact with the resistor body 20. The upper surface protection film 50 covers the entire surface of the resistor body 20. The peripheral portion 51 is in contact with the upper surface 11 of the substrate 10. In the chip resistor 213, the first upper surface electrode and the second upper surface electrode of the embodiment are omitted. In the chip resistor shown in FIGS. 17 and 18, the first side surface protection film 61 and the second side surface protection film 62 include the side surface portion 61*a*, the side surface portion 62*a*, the lower surface portion 61*c*, and the lower surface portion 62*c* and do not include an upper surface portion. The first side surface protection film 61 and the second side surface protection film 62 may be a side surface protection film that includes an upper surface portion or may be a side surface protection film that does not include a lower surface portion. Further, the side surface protection films may be omitted.

The chip resistor according to the present disclosure is not limited to the embodiment and the modified examples described above. Each component of the chip resistor according to the present disclosure may have a specific configuration that is variously designed and changed in any manner.

DESCRIPTION OF THE REFERENCE NUMERALS

1, 201 to 213) chip resistor; 10) substrate; 11) upper surface; 12) lower surface; 17) first through hole; 18) second through hole; 20) resistor body; 31) first upper surface electrode; 32) second upper surface electrode; 41) first lower surface electrode; 42) second lower surface electrode; 50) upper surface protection film; 51) peripheral portion; 61) first side surface protection film; 61*a*) side surface portion; 61*b*) upper surface portion; 61*c*) lower surface portion; 62) second side surface protection film; 62*a*) side surface portion; 62*b*) upper surface portion; 62*c*) lower surface portion; 71) first inner electrode; 72) second inner electrode

The invention claimed is:

1. A chip resistor, comprising:

a substrate including an upper surface and a lower surface that face in opposite directions in a thickness-wise direction, a first side surface and a second side surface that face in opposite directions in a first direction, the first direction being orthogonal to the thickness-wise direction, and a first through hole and a second through hole that extend through the substrate between the upper surface and the lower surface;

a resistor body disposed on the upper surface;

an upper surface protection film covering the resistor body and including a peripheral end portion that is entirely in contact with the upper surface;

a first upper surface electrode and a second upper surface electrode disposed on the upper surface, each of the first upper surface electrode and the second upper surface electrode including an inner end overlapping the resistor body;

a first lower surface electrode and a second lower surface electrode disposed on the lower surface and separated from each other in the first direction;

a first inner electrode disposed in the first through hole and connecting the resistor body and the first lower surface electrode;

a second inner electrode disposed in the second through hole and connecting the resistor body and the second lower surface electrode;

a first side surface protection film disposed on the first side surface; and a second side surface protection film disposed on the second side surface, wherein the first side surface protection film is electrically connected to the first lower surface electrode and is electrically disconnected from the first upper surface electrode, and wherein the second side surface protection film is electrically connected to the second lower surface electrode and is electrically disconnected from the second upper surface electrode.

2. The chip resistor according to claim 1, wherein each of the first through hole and the second through hole has a circular opening in the upper surface.

3. The chip resistor according to claim 1, wherein each of the first through hole and the second through hole has a quadrangular opening in the upper surface.

4. The chip resistor according to claim 1, wherein at least one of the first inner electrode or the second inner electrode includes a plurality of first inner electrodes or a plurality of second inner electrodes, respectively.

5. The chip resistor according to claim 1, wherein the first lower surface electrode and the second lower surface electrode include silver.

6. The chip resistor according to claim 1, wherein the first inner electrode and the second inner electrode include silver.

7. The chip resistor according to claim 1, wherein the substrate is formed from alumina.

8. The chip resistor according to claim 1, wherein the first inner electrode connects the first lower surface electrode and the first upper surface electrode, the second inner electrode connects the second lower surface electrode and the second upper surface electrode, the upper surface protection film covers the first upper surface electrode and the second upper surface electrode, and the peripheral end portion is in contact with the upper surface.

9. The chip resistor according to claim 1, wherein the first lower surface electrode and the second lower surface electrode are smaller in thickness than the first upper surface electrode and the second upper surface electrode.

10. The chip resistor according to claim 1, wherein the first inner electrode directly connects the first lower surface electrode to the resistor body, and the second inner electrode directly connects the second lower surface electrode to the resistor body.

11. The chip resistor according to claim 1, wherein the first side surface protection film includes a side surface portion covering the first side surface, and the second side surface protection film includes a side surface portion covering the second side surface.

12. The chip resistor according to claim 11, wherein the first side surface protection film includes a lower surface portion covering the lower surface of the substrate, and the second side surface protection film incudes a lower surface portion covering the lower surface of the substrate.

13. The chip resistor according to claim 12, wherein the lower surface portion of the first side surface protection film is in contact with the first lower surface electrode, and the lower surface portion of the second side surface protection film is in contact with the second lower surface electrode.

14. The chip resistor according to claim 11, wherein the first side surface protection film includes an upper surface portion covering the upper surface of the substrate, and the second side surface protection film includes an upper surface portion covering the upper surface of the substrate.

15. The chip resistor according to claim 14, wherein the upper surface portion is in contact with the peripheral end portion of the upper surface protection film in the first direction.

16. The chip resistor according to claim 1, wherein the first side surface protection film and the second side surface protection film include a metal film.

17. The chip resistor according to claim 16, wherein the metal film includes a first metal film in contact with the substrate and a second metal film in contact with a surface of the first metal film.

18. The chip resistor according to claim 17, wherein the first metal film includes nickel, and the second metal film includes tin.

19. The chip resistor according to claim 1, wherein the upper surface protection film includes a first protection film in contact with an upper surface of the resistor body and a second protection film in contact with at least part of an upper surface of the first protection film.

* * * * *